United States Patent [19]

Almgren et al.

[11] Patent Number: 4,559,585

[45] Date of Patent: Dec. 17, 1985

[54] ILLUMINATING ARRANGEMENT IN MICROWAVE OVENS

[75] Inventors: Per H. I. Almgren; Christian H. P. Durne, both of Norrköping, Sweden

[73] Assignee: U.S. Philips Corporation, New York, N.Y.

[21] Appl. No.: 589,791

[22] Filed: Mar. 15, 1984

[30] Foreign Application Priority Data

Mar. 23, 1983 [SE] Sweden ..... 8301593

[51] Int. Cl.[4] ..... F21V 33/00; H05B 6/68

[52] U.S. Cl. ..... 362/92; 219/10.55 R; 219/10.55 E

[58] Field of Search ..... 362/92, 94; 219/10.55 R, 10.55 B, 10.55 E

[56] References Cited

U.S. PATENT DOCUMENTS

| | | | |
|---|---|---|---|
| 2,993,973 | 7/1961 | Johnson et al. | 219/10.55 R |
| 4,254,450 | 3/1981 | White et al. | 362/92 |
| 4,326,243 | 4/1982 | Pistor et al. | 362/92 |
| 4,367,388 | 1/1983 | Ishimara et al. | 219/10.55 B |
| 4,431,889 | 2/1984 | Saponara et al. | 219/10.55 R |

FOREIGN PATENT DOCUMENTS

| | | | |
|---|---|---|---|
| 0021640 | 2/1979 | Japan | 219/10.55 R |

*Primary Examiner*—Craig R. Feinberg
*Attorney, Agent, or Firm*—Rolf E. Schneider

[57] ABSTRACT

An arrangement for illuminating the interior of a microwave oven cavity comprises a lamp (21) mounted in a lamp holder (19, 20) which is disposed outside the oven cavity behind a window in a cavity wall (10). The lamp holder (19, 20) is arranged axially within an electrically conductive sleeve (12) mounted on the outside of the cavity wall (10) and connected to cavity wall parts surrounding an aperture (11) in the cavity wall bounding the window so that the lamp (21) is axially arranged within the sleeve (12). The sleeve (12) constitutes a waveguide having the aperture (11) as input and having a cut-off wavelength smaller than the operating wavelength of the microwave oven, and the mounted lamp (21) has its filament (22) at a sufficient distance (H) from the aperture (11) for leaking microwave energy reaching the filament (22) to have been considerably attenuated. Microwave energy leakage is thereby substantially prevented both if the lamp (21) is mounted and if the lamp (21) is absent. The lamp (21) is readily accessible from the interior of the cavity for replacement.

3 Claims, 2 Drawing Figures

ILLUMINATING ARRANGEMENT IN MICROWAVE OVENS

The invention relates to an arrangement for illuminating the interior of a microwave oven cavity comprising a lamp mounted in a lamp holder which is disposed outside the oven cavity behind a window in a cavity wall so that light emitted by the lamp is transmitted to the interior of the cavity through the window.

In known illuminating arrangements for microwave ovens, the window usually consists of a perforated part of the cavity wall, compare e.g. U.S. Pat. No. 4,367,388. This type of illuminating arrangement has the drawback that the lamp is only accessible from the outside of the cavity, implying that the whole outer envelope of the cavity, or at least a part of this envelope, must be removed for replacement of the lamp. A further drawback is that such perforated windows intercept an important part of the light emitted by the lamp.

In other known illuminating arrangements, particularly in those arrangements that are adapted to built-in microwave ovens or combined heating microwave ovens, the lamp is accessible from the interior of the cavity, compare e.g. German "Auslegeschrift" No. 28 31 804. In this type of illuminating arrangement, a metallic screen grid serving as a microwave shield is arranged in or behind a transparent disc or lens covering the window. In order to prevent microwave energy leakage if one forgets to mount the microwave shield, a switch is provided which must be activated by the microwave shield, or a holder fixed to the shield, to enable the microwave oven to be started. This arrangement is complicated and the microwave shield also reduces the degree of illumination.

It is an object of the invention to provide an arrangement of the type set forth in the opening paragraph, by which the interior of the microwave oven cavity can be illuminated without needing to use microwave shields which intercept light and produce disturbing shadow patterns, in which the lamp is accessible from the interior of the cavity for replacement, and in which microwave energy leakage is effectively prevented.

According to the invention the illuminating arrangement is characterized in that the lamp holder is coaxially arranged within an electrically conductive sleeve mounted on the outside of the cavity wall so that the lamp can be axially arranged within the sleeve, one end of the sleeve being electrically connected at microwave frequencies to cavity wall parts surrounding an aperture in the cavity wall bounding the window, which can be covered by a transparent body in that the waveguide constituted by the sleeve and having the aperture as input has a cut-off wavelength smaller than the wavelength corresponding to the operating frequency of the microwave oven, in that the mounted lamp has its filament within the sleeve at a sufficient distance from the aperture for leaking microwave energy reaching the filament to have been substantially attenuated, and in that the arrangement is adapted to enable access to the lamp from the interior of the cavity, the lamp being removable through the sleeve.

The electrically conductive sleeve of illuminating arrangements embodying the invention provides protection against leakage of microwave energy both if the lamp is mounted and if the lamp is absent. In the latter case the protection against leakage will even be improved owing to the absence of the lamp filament, which could act as an "antenna" and thereby contribute to the leakage of microwave energy out of the cavity.

The prevention of microwave energy leakage is the result of two phenomena:

1. The aperture in the cavity wall gives a certain reflection of the microwave energy impinging on the wall plane; the reflection factor depends on the ratio between the aperture diameter and the operating wavelength of the microwave energy.

2. As regards the filament, the sleeve around the lamp constitutes a waveguide having a radius which is substantially smaller than the cut-off wavelength. When such a waveguide is used at a wavelength greater than the cut-off wavelength, the microwave energy is attenuated exponentially, the attenuation being given by the formula:

$$\alpha = (54.6/\lambda_c)\sqrt{1-(\lambda_c/\lambda)^2} \quad (1)$$

where $\alpha$=attenuation in dB/cm $\lambda_c$=cut-off wavelength in cm $\lambda$=operating wavelength in cm (usually 12.2 cm).

For a circular waveguide $\lambda_c=3.41\ a$ where a=radius of the waveguide in cm.

The total microwave energy leakage is therefore a function of the sleeve diameter and of the diameter of the sleeve in relation to the operating wavelength as well as the distance between the aperture and the filament wire.

In order to be effective as a microwave barrier, the sleeve preferably has a diameter as small as possible, i.e. an inner diameter only slightly exceeding the outer diameter of the lamp. However, with a conventional lamp holder, it will then be difficult to replace the lamp without special tools because of the arrangement of the lamp within the sleeve.

This problem is solved in a first embodiment of the invention in that the lamp holder is mounted in an inner sleeve received from the interior of the cavity in the sleeve electrically connected to the cavity wall. When the lamp needs replacement, the resilience of the mounting can then be utilized for ejecting the lamp from the sleeve.

The invention will now be described with reference to the accompanying drawing, in which.

Figure 1:
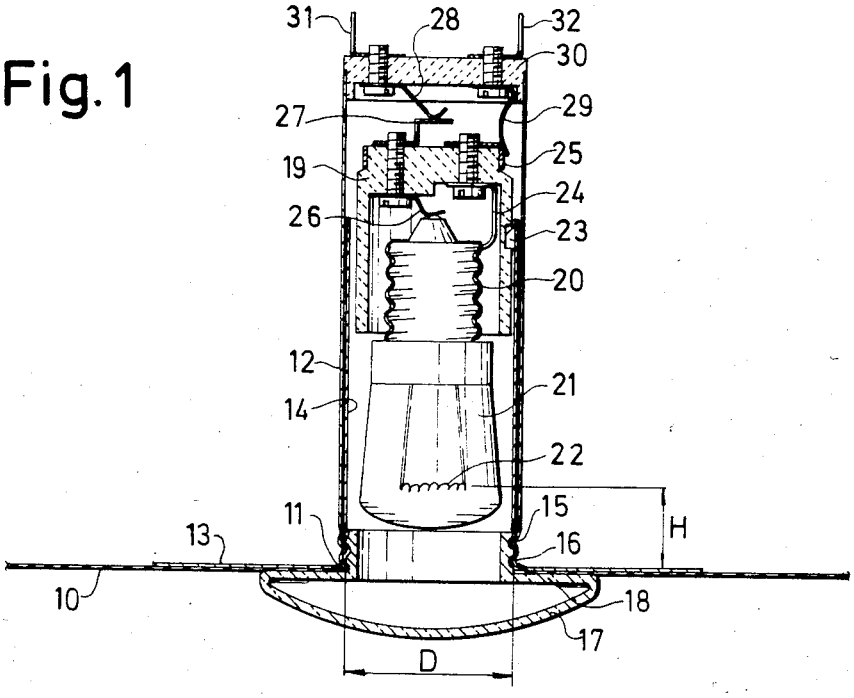
FIG. 1 shows a first illustrative embodiment of the invention.

In FIG. 1, reference numeral 10 designates a cavity wall in which an aperture 11 is made, 12 is a metallic sleeve having a ring shaped flange 13 fastened to the outer side of the cavity wall; and 14 is a second metallic sleeve which is displaceable within the sleeve 12. The sleeves 12 and 14 may be made of chromium-plated brass. At their ends adjacent the cavity, the sleeves 12, 14 are provided with co-operating threads 15 and 16 so that the inner sleeve 14 can be screwed into the outer sleeve 12. At the same end, the inner sleeve 14 supports a plano-convex glass body comprising a diffusing dome 17. After screwing the inner sleeve into the outer sleeve, the flat flange 18 of the disc 17 will bear against the cavity wall parts surrounding the aperture 11 so that the aperture is covered. At the opposite end, the sleeve 14 supports a lamp holder consisting of a ceramic sleeve 19 and a metallic threaded sleeve 20, into the latter of which a lamp 21 with a filament 22 is screwed. The lamp holder 19, 20 is fixed in the sleeve 14 by means of a snap fastener 23. The threaded sleeve 20 within the lamp holder is supported by an electric conductor 24 connected to a slip ring 25 arranged outside the ceramic sleeve 19, while a center contact 26 situated in the bottom of the lamp holder leads to a corresponding center contact 27 outside the lamp holder. Two counter-contacts 28, 29 co-operating with the slip ring 25 and the center contact 27, respectively, are supported by a ceramic disc 30 fixed to the outer sleeve 12 and lead to connection tangs 31, 32 for the voltage supply.

Replacement of the lamp is effected via the cavity by unscrewing the inner sleeve 14 from the outer sleeve 12, using the glass done 17 as a handle. After disengaging the snap fastener 23, the lamp can be unscrewed from its holder and replaced.

Figure 2:
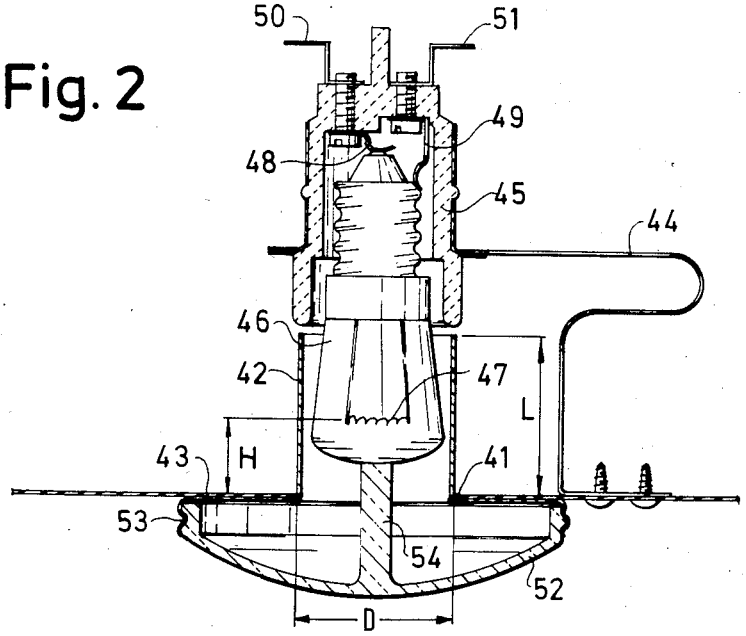
FIG. 2 shows a second illustrative embodiment of the invention.

FIG. 2 shows a second embodiment of the invention. An aperture 41 is made in the cavity wall and a metallic sleeve 42 having a flange 43 is fastened to the outer side of the cavity wall. An U-shaped leaf spring 44 is also fastened to the cavity wall and supports a lamp holder 45 for a lamp 46 having a filament 47. In its bottom, the lamp holder has two contacts 48, 49 co-operating with contacts on the lamp and leading to connections tangs 50, 51. A circumferentially threaded glass dome 52 is screwed into a ring-shaped threaded holder 53 providing a continuation of the metallic sleeve 42 and the flange 43. The glass dome 52 has a central pin 54 which when the dome is mounted presses against the lamp bulb and keeps the lamp in place in the lamp holder.

To replace the lamp, the glass dome 52 is first unscrewed from its holder 53. If the illuminating arrangement is disposed in the roof of the cavity, the lamp then falls out by the force of gravity. Should the illuminating arrangement be situated in any of the side walls, the lamp bulb is first pressed inwardly by means of a finger, whereafter the finger is removed rapidly. The lamp is then ejected by the return motion of the leaf spring 44.

The dimensions which are important for preventing microwave energy leakage are firstly the diameter of the sleeve surrounding the lamp and secondly the distance between the filament of the lamp and the plane of the sleeve aperture. In the drawings these dimensions are designated D and H, respectively. The diameter D must have a certain relation to the operating wavelength within the cavity; more particularly, the cut-off wavelength of the waveguide constituted by the sleeve must be substantially smaller than the operating wavelength. In combination with a sufficient length of the sleeve, designated L in FIG. 2, this results in the waveguide sleeve being quite impervious to the microwave energy if the lamp is not mounted. If the lamp is mounted, the distance H must exceed a certain value, which is determined by the requirement that the leakage energy reaching the filament in the waveguide sleeve must have been attenuated to a given low level. The magnitude of H can be calculated by means of the formula (1) or can be determined empirically. As mentioned, the sleeve length must also exceed a given value which, however, is not critical.

An example of such dimensioning for $\lambda=12.2$ cm results in the following values:

$D=2.3$ cm $H=0.5$ cm $L=2.5$ cm

The cut-off wavelength $\lambda_c$ for this sleeve amounts to about 4 cm.

What is claimed is:

1. An arrangement for illuminating an interior of cavity of a microwave oven comprising a lamp mounted in a lamp holder which is disposed outside the oven cavity behind a window in a cavity wall so that light emitted by the lamp is transmitted to the interior of the cavity through the window, characterized in that the lamp holder is coaxially arranged within an electrically conductive sleeve mounted on an outside surface of the cavity wall so that the lamp can be axially arranged within the sleeve, one end of the sleeve being electrically connected at microwave frequencies to cavity wall parts surrounding an aperture in the cavity wall bounding the window, which can be covered by a transparent body, in that a resulting waveguide constituted by the sleeve and having the aperture as input has a cut-off wavelength smaller than that of operating frequency of the microwave oven, in that the mounted lamp has its filament within the sleeve at a sufficient distance from the aperture for leaking microwave energy reaching the filament to have been substantially attenuated, and in that the arrangement is adapted to enable access to the lamp, from the interior of the cavity, the lamp being removable through the sleeve and aperture.

2. An illuminating arrangement as claimed in claim 1, characterized in that the lamp holder is mounted in an inner sleeve received from the interior of the cavity in the sleeve electrically connected to the cavity wall.

3. An illuminating arrangement as claimed in claim 1, characterized in that the lamp holder is resiliently mounted adjacent the other end of the sleeve and in that a transparent body covering the aperture is adapted to press the lamp into the lamp holder.

* * * * *